US010954956B2

(12) United States Patent
Chang et al.

(10) Patent No.: US 10,954,956 B2
(45) Date of Patent: Mar. 23, 2021

(54) FAN

(71) Applicant: DELTA ELECTRONICS, INC., Taoyuan (TW)

(72) Inventors: Shun-Chen Chang, Taoyuan (TW); Po-Cheng Kung, Taoyuan (TW); Shih-Di Chen, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 122 days.

(21) Appl. No.: 16/161,731

(22) Filed: Oct. 16, 2018

(65) Prior Publication Data

US 2019/0293084 A1 Sep. 26, 2019

(30) Foreign Application Priority Data

Mar. 22, 2018 (CN) ..... 201810237755.1

(51) Int. Cl.

| | |
|---|---|
| ***F04D 29/32*** | (2006.01) |
| ***F04D 25/12*** | (2006.01) |
| ***F04D 25/06*** | (2006.01) |
| ***F04D 29/38*** | (2006.01) |
| ***F04D 19/00*** | (2006.01) |
| ***F04D 29/54*** | (2006.01) |

(52) U.S. Cl.

CPC ..... *F04D 29/325* (2013.01); *F04D 19/002* (2013.01); *F04D 25/0613* (2013.01); *F04D 25/12* (2013.01); *F04D 29/384* (2013.01); *F04D 29/541* (2013.01); *F05D 2210/42* (2013.01); *F05D 2240/30* (2013.01); *F05D 2250/712* (2013.01)

(58) Field of Classification Search

CPC .... F04D 29/325; F04D 29/281; F04D 19/002; F04D 25/0613; F05D 2210/42

See application file for complete search history.

(56) References Cited

U.S. PATENT DOCUMENTS

| | | | | |
|---|---|---|---|---|
| 3,574,480 A * | 4/1971 | Hoepfner | ..... | F04D 29/30 415/211.1 |
| 4,371,313 A * | 2/1983 | Burgbacher | ..... | F04D 29/626 415/182.1 |
| 8,240,989 B2 * | 8/2012 | Liu | ..... | F04D 25/0613 415/216.1 |

(Continued)

FOREIGN PATENT DOCUMENTS

| | | |
|---|---|---|
| CN | 1272598 A | 11/2000 |
| CN | 107795514 A | 3/2018 |

*Primary Examiner* — Nathaniel E Wiehe
*Assistant Examiner* — Jackson N Gillenwaters
(74) *Attorney, Agent, or Firm* — Muncy, Geissler, Olds & Lowe, P.C.

(57) ABSTRACT

A fan includes a fan frame, an impeller, and at least a supporting member. The fan frame includes a bottom plate and a cover plate spaced from the bottom plate. The bottom plate and the cover plate together define a first accommodating space. The cover plate has an air inlet disposed in an axial direction. A side of the fan frame is provided with at least an air outlet. The impeller is disposed in the first accommodating space and includes a hub and a plurality of blades. A cross-sectional area of the hub increases gradually along a direction from the cover plate to the bottom plate. The blades are disposed around the periphery of the hub. The supporting member is disposed between the bottom plate and the cover plate for supporting the cover plate.

13 Claims, 3 Drawing Sheets

(56) References Cited

U.S. PATENT DOCUMENTS

| | | | | |
|---|---|---|---|---|
| 8,408,884 | B2 * | 4/2013 | Hsu | F04D 29/54 417/423.1 |
| 8,702,386 | B2 * | 4/2014 | Lee | F04D 29/384 415/211.2 |
| 8,992,175 | B2 * | 3/2015 | Heli | F04D 25/0613 415/121.2 |
| 9,039,361 | B2 * | 5/2015 | Fukuda | F04D 25/0613 415/206 |
| 9,127,687 | B2 * | 9/2015 | Fujimoto | F04D 17/16 |
| 10,267,340 | B2 * | 4/2019 | Barron | F04D 19/002 |
| 2014/0309965 | A1 * | 10/2014 | Horng | F04D 29/281 702/170 |
| 2014/0356149 | A1 * | 12/2014 | Chang | F04D 29/666 415/193 |
| 2019/0390676 | A1 * | 12/2019 | Ishii | F04D 29/4226 |

* cited by examiner

FAN

CROSS REFERENCE TO RELATED APPLICATIONS

This Non-provisional application claims priority under 35 U.S.C. § 119(a) on Patent Application No(s). 201810237755.1 filed in People's Republic of China on Mar. 22, 2018, the entire contents of which are hereby incorporated by reference.

BACKGROUND OF THE INVENTION

Field of Invention

The present disclosure relates to a fan and, in particular, to a fan having a compact size and capable of providing the lateral air output and increasing the heat-dissipating efficiency.

Related Art

As the progress of technical industry, the electronic devices, such as the desktop computer, notebook computer, smart phone, tablet, or the likes, have been frequently used in our daily lives. The internal electronic components of the electronic device will generate a lot of heat during the operation of the electronic device, and the generated heat can affect the operation performance of the electronic device. Accordingly, the electronic device is usually configured with a proper heat dissipation system for dissipating the generated heat.

The common heat dissipation system usually includes a fan, such as an axial-flow fan or a centrifugal fan. In the market (e.g. vehicle market), more and more fans utilize the lateral air output design for providing the solution of heat dissipation. However, the centrifugal fan cannot reach the small size design due to the space limitation. In general, the size of the general centrifugal fan is greater than 6 cm. Accordingly, an axial-flow fan will be provided with forming a hole on the side wall of the fan frame and sealing the air outlet, thereby forcing the air to flow through the hole so as to provide the lateral air output. However, the impeller pushes the air to generate the airflow in the axial direction, so that the above design will cause a huge resistance to the airflow, which can sufficiently decrease the heat-dissipating efficiency.

Therefore, it is desired to provide a fan having a compact size (4~6 cm), and capable of providing the lateral air output and increasing the heat-dissipating efficiency.

SUMMARY OF THE INVENTION

An objective of this disclosure is to provide a fan having a compact size (4~6 cm), and capable of providing the lateral air output and increasing the heat-dissipating efficiency.

This disclosure provides a fan comprising a fan frame, an impeller, and at least a supporting member. The fan frame comprises a bottom plate and a cover plate spaced from the bottom plate. The bottom plate and the cover plate together define a first accommodating space. The cover plate has an air inlet disposed in an axial direction, and a side of the fan frame is provided with at least an air outlet. The impeller is disposed in the first accommodating space and comprises a hub and a plurality of blades. A cross-sectional area of the hub increases gradually along a direction from the cover plate to the bottom plate. The blades are disposed around a periphery of the hub. The supporting member is disposed between the bottom plate and the cover plate for supporting the cover plate.

In one embodiment, the hub has a top surface, and a recess portion is provided on the top surface.

In one embodiment, the periphery of the hub is a planar surface or a curved surface.

In one embodiment, a tangent direction of the curved surface from the air inlet to the air outlet turns from a near-axial direction to a near-radial direction.

In one embodiment, the cover plate has a slant surface located at an inner side of the air inlet, and the slant surface is a planar surface, a curved surface, or a combination thereof.

In one embodiment, each of the blades of the impeller has a non-uniform cross-sectional thickness.

In one embodiment, the supporting member has a guiding surface.

In one embodiment, the fan frame has a circle shape or a rectangular shape.

In one embodiment, when the fan frame has the circle shape, a diameter of the fan frame ranges from 4 cm to 6 cm.

In one embodiment, when the fan frame has the rectangle shape, a length and a width of the fan frame range from 4 cm to 6 cm.

In one embodiment, the fan comprises four supporting members and four air outlets, and the four air outlets are disposed within four intervals between every adjacent two of the four supporting members, respectively.

In one embodiment, the air outlet is provided with at least a guiding blade.

In one embodiment, the bottom plate is provided with a second accommodating space for supporting a motor circuit board.

As mentioned above, in the fan of this disclosure, a side of the fan frame is provided with at least an air outlet, the cross-sectional area of the hub increases gradually along a direction from the cover plate to the bottom plate, and the supporting member supports the cover plate. Accordingly, the fan of this disclosure can provide the lateral air outlet and increase the heat-dissipating efficiency. Compared with the conventional axial-flow fan and centrifugal fan, the fan of this disclosure has a smaller size (4~6 cm) and is not limited to the available space.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

A fan of this disclosure has a compact size and is capable of providing the lateral air output and increasing the heat-dissipating efficiency. The structure and features of the fan of this disclosure will be described in the following embodiment.

Figure 1:
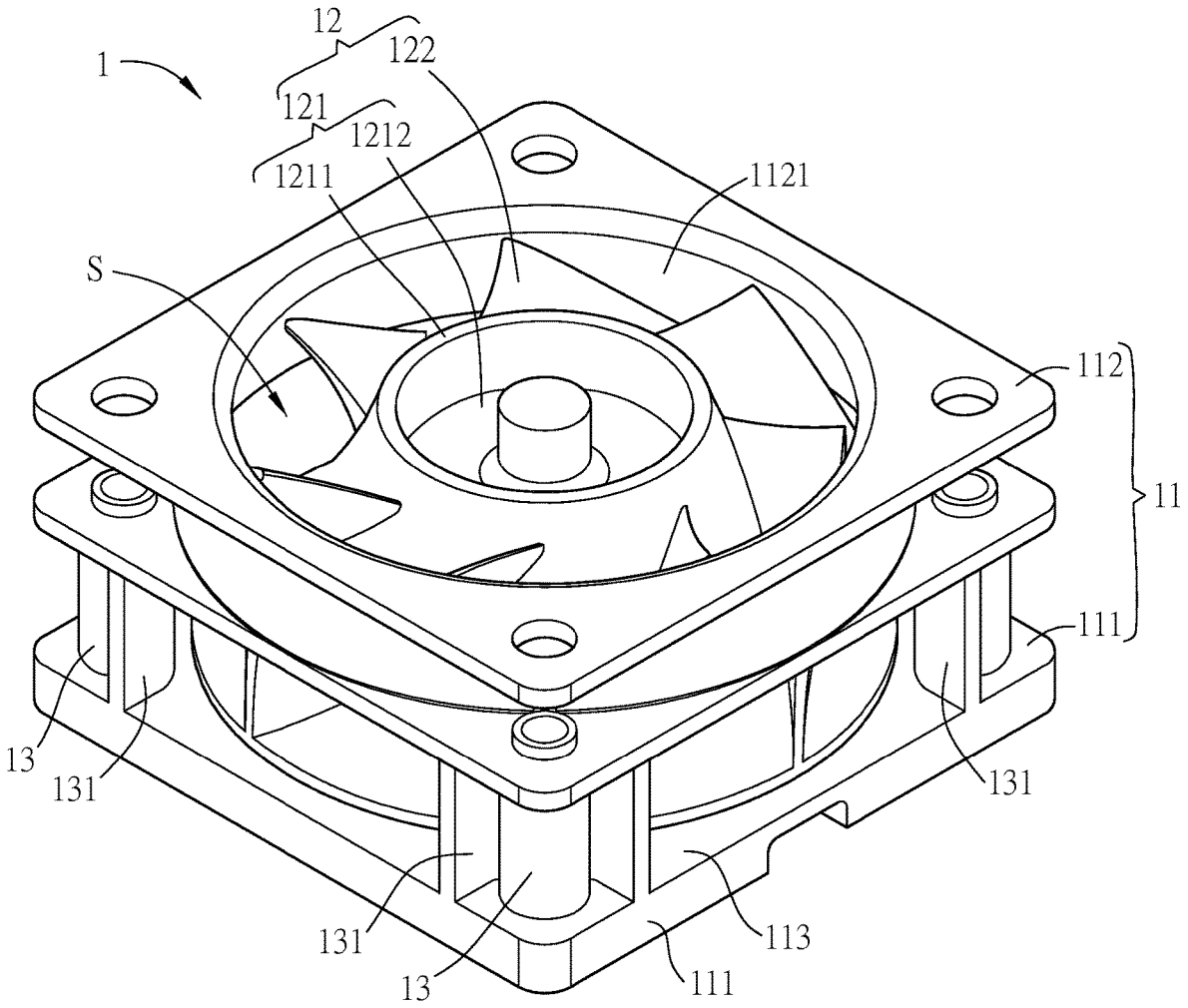
FIG. 1 is a schematic diagram showing a fan according to an embodiment of this disclosure.
Figure 2:
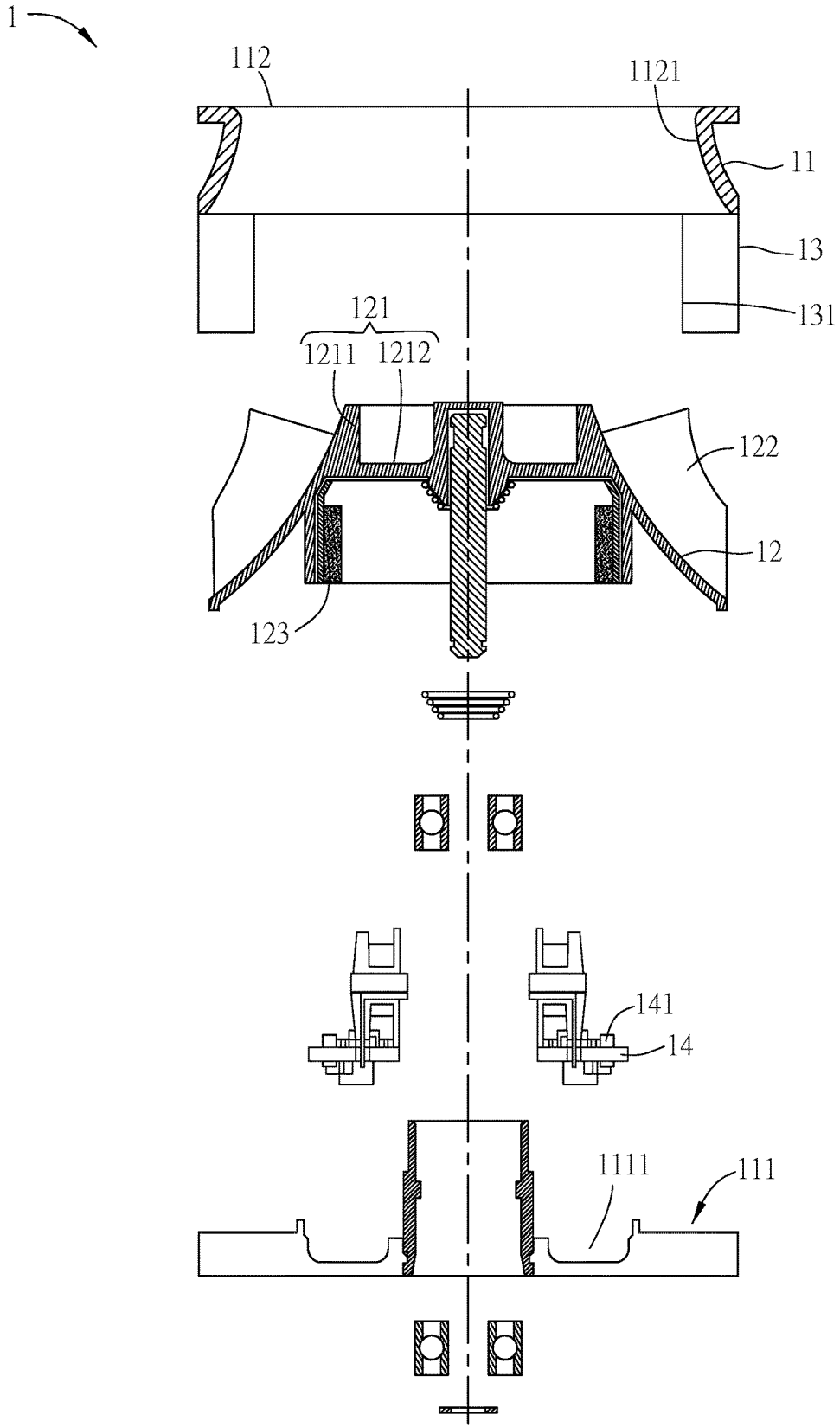
FIG. 2 is an exploded view of the fan according to the embodiment of this disclosure.
Figure 3:
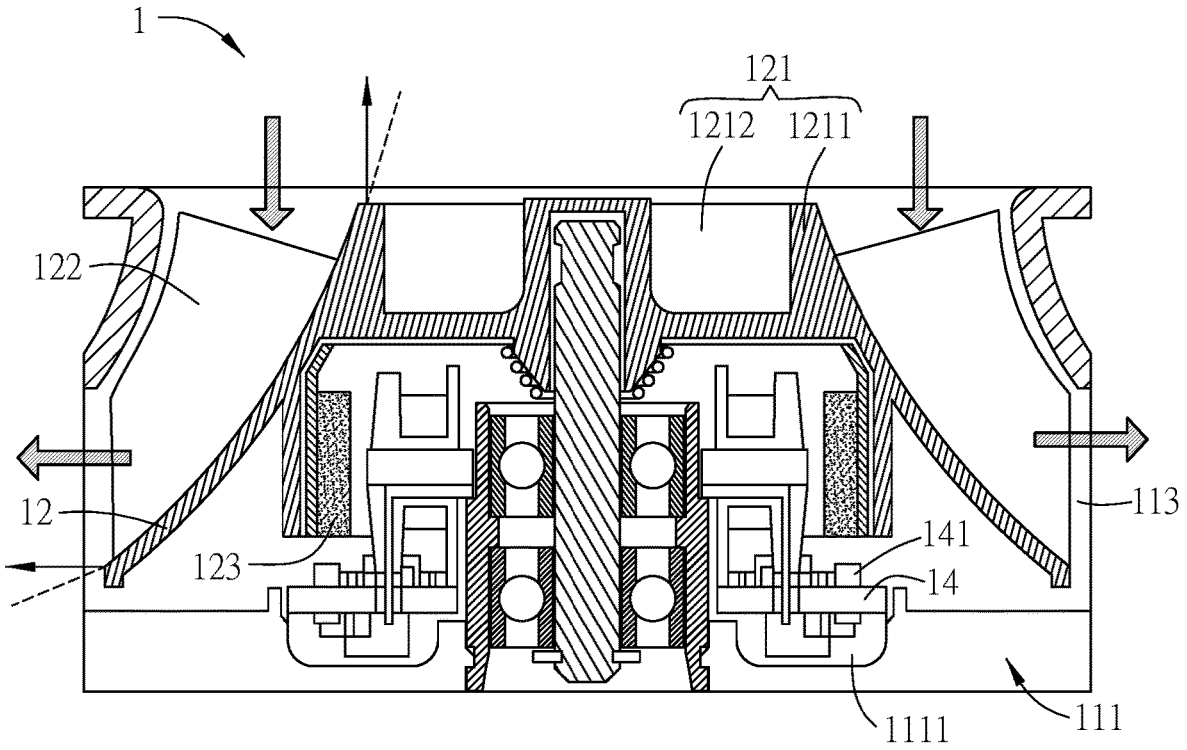
FIG. 3 is a cross-sectional view of the fan according to the embodiment of this disclosure.

FIG. 1 is a schematic diagram showing a fan 1 according to an embodiment of this disclosure, FIG. 2 is an exploded view of the fan 1, and FIG. 3 is a cross-sectional view of the fan 1. Referring to FIGS. 1 to 3, the fan 1 includes a fan frame 11, an impeller 12, and at least a supporting member 13. The fan frame 11 comprises a bottom plate 111 and a cover plate 112 spaced from the bottom plate 111. The bottom plate 111 and the cover plate 112 together define a first accommodating space S. The cover plate 112 has an air inlet disposed in an axial direction, and a side of the fan frame 11 is provided with at least an air outlet 113. The impeller 12 is disposed in the first accommodating space S and comprises a hub 121 and a plurality of blades 122. A cross-sectional area of the hub 121 increases gradually along a direction from the cover plate 112 to the bottom plate 111. The blades 122 are disposed around a periphery of the hub 121. The supporting member 13 is disposed between the bottom plate 111 and the cover plate 112 for supporting the cover plate 112.

In this embodiment, the hub 121 has a top surface 1211, and a recess portion 1212 is provided on the top surface 1211. The design of the recess portion 1212 can make the hub 121 to have a uniform thickness, thereby decreasing the entire weight of the hub 121 and increasing the rotation efficiency of the impeller 12.

In this embodiment, the periphery of the hub 121 is a planar surface, a curved surface or a combination thereof. Herein, a tangent direction of the curved surface from the air inlet to the air outlet 113 turns from the near-axial direction to the near-radial direction Referring to FIG. 1, the cover plate 112 has a slant surface 1121 located at an inner side of the air inlet, and the slant surface 1121 is a planar surface, a curved surface, or a combination thereof. Herein, the curved surface can be a concave surface, a convex surface, or a combination thereof, and this disclosure is not limited.

In this embodiment, each of the blades 122 of the impeller 12 has a non-uniform cross-sectional thickness. In other words, each of the blades 122 of the impeller 12 has a non-uniform thickness. This design of non-uniform thickness can further decrease the air resistance and noise of the fan 1 and increase the rotation efficiency of the impeller 12.

In this embodiment, the supporting member 13 has a guiding surface 131. Accordingly, when the fan 1 operates to dissipate the heat, the guiding surface 131 can concentrate the generated airflow toward the air outlet (lateral air outlet) so as to increase the heat-dissipating efficient of the fan 1.

In this embodiment, the fan frame 11 has a circle shape or a rectangular shape, and this disclosure is not limited thereto. For example, when the fan frame 11 has a circle shape, a diameter of the fan frame 11 ranges from 4 cm to 6 cm. Alternatively, when the fan frame 11 has a rectangle shape, a length and a width of the fan frame 11 range from 4 cm to 6 cm. As shown in FIGS. 1 and 2, the fan frame 11 has a rectangle shape.

As shown in FIGS. 1 and 2, in this embodiment, the fan 1 comprises four supporting members 13 and four air outlets 113, and the four air outlets 113 are disposed within four intervals between every adjacent two of the four supporting members 13, respectively. To be noted, the numbers of the supporting members 13 and the air outlets 113 are not limited in this disclosure.

In this embodiment, the air outlet 113 can be provided with at least a guiding blade (not shown). The configuration of the guiding blade can guide the airflow to provide the lateral airflow for increasing the heat-dissipating efficiency. For example, as shown in FIG. 3, the airflow enters the fan 1 along the arrow direction and is then laterally outputted through the air outlet 113.

In this embodiment, the bottom plate 111 is provided with a second accommodating space 1111 for supporting a motor circuit board 14, so that the motor circuit board 14 is not disposed over the bottom plate 111. This design can further effectively decrease the entire height of the fan 1. Specifically, a magnet 123 is provided at the inner side of the hub 121 of the impeller 12, and the motor circuit board 14 has an electromagnetic induction element 141. Since the second accommodating space 1111 is designed for supporting the motor circuit board 14, a larger space for disposing electronic devices can be provided above the motor circuit board 14. Thus, the electromagnetic induction element 141 disposed on the motor circuit board 14 can be positioned under the magnet 123 and on the axis of the magnet 123. This configuration can allow the electromagnetic induction element 141 to be induced by the magnet 123 precisely.

In this embodiment, the fan 1 of this disclosure is a mixed flow fan. Compared with the conventional axial-flow fan and centrifugal fan, the fan 1 of this disclosure has a smaller size and can provide lateral air outlet.

To sum up, in the fan 1 of this disclosure, a side of the fan frame 11 is provided with at least an air outlet 113, the cross-sectional area of the hub 121 increases gradually along a direction from the cover plate 112 to the bottom plate 111, and the supporting member 13 supports the cover plate 112. Accordingly, the fan 1 of this disclosure can provide the lateral air outlet and increase the heat-dissipating efficiency. Compared with the conventional axial-flow fan and centrifugal fan, the fan 1 of this disclosure has a smaller size (4~6 cm) and is not limited to the available space.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

a fan frame comprising a bottom plate and a cover plate spaced from the bottom plate, wherein the bottom plate and the cover plate together define a first accommodating space, the cover plate has an air inlet disposed in an axial direction, and a side of the fan frame is provided with at least an air outlet;

an impeller disposed in the first accommodating space and comprising:

a hub, wherein a cross-sectional area of the hub increases gradually along a direction from the cover plate to the bottom plate, and a plurality of blades disposed around a periphery of the hub, wherein the blades do not contact the cover plate, and a slant channel is built with the hub, the blades and the cover plate; and at least a supporting member, wherein one end of the supporting member is connected to the bottom plate, and another end of the supporting member is connected to the cover plate, wherein the minimum width of a cross-sectional area of the air inlet is smaller than the maximum width of a cross-sectional area of the hub.

2. The fan according to claim 1, wherein the hub has a top surface, and a recess portion is provided on the top surface.

3. The fan according to claim 1, wherein the periphery of the hub is a planar surface or a curved surface.

4. The fan according to claim 3, wherein a tangent direction of the curved surface varies from the air inlet to the air outlet.

5. The fan according to claim 4, wherein the cover plate has a slant surface located at an inner side of the air inlet, and the slant surface is a planar surface, a curved surface, or a combination thereof.

6. The fan according to claim 1, wherein each of the blades of the impeller has a non-uniform cross-sectional thickness.

7. The fan according to claim 1, wherein the supporting member has a guiding surface.

8. The fan according to claim 1, wherein the fan frame has a circle shape or a rectangular shape.

9. The fan according to claim 8, wherein when the fan frame has the circle shape, a diameter of the fan frame ranges from 4 cm to 6 cm.

10. The fan according to claim 8, wherein when the fan frame has the rectangle shape, a length and a width of the fan frame range from 4 cm to 6 cm.

11. The fan according to claim 1, wherein the fan comprises four of the supporting members and four of the air outlets, and the four air outlets are disposed within four intervals between every adjacent two of the four supporting members, respectively.

12. The fan according to claim 1, wherein the air outlet is provided with at least a guiding blade.

13. The fan according to claim 1, wherein the bottom plate is provided with a second accommodating space for supporting a motor circuit board.

* * * * *